US006810773B2

(12) United States Patent
Trucchio

(10) Patent No.: US 6,810,773 B2
(45) Date of Patent: Nov. 2, 2004

(54) OPEN END RATCHET WRENCH

(76) Inventor: Frank Trucchio, 16335 SW. 103rd St., Miami, FL (US) 33196

( * ) Notice: Subject to any disclaimer, the term of this patent is extended or adjusted under 35 U.S.C. 154(b) by 11 days.

(21) Appl. No.: 10/329,656

(22) Filed: Dec. 23, 2002

(65) Prior Publication Data

US 2004/0118253 A1 Jun. 24, 2004

(51) Int. Cl.[7] ..... B25B 17/00

(52) U.S. Cl. ..... 81/58.2; 81/13; 81/57.31; 81/57.32; 81/57.39

(58) Field of Search ..... 81/58.2, 58.1, 81/57.31, 57.32, 57.36, 57.39, 13

(56) References Cited

U.S. PATENT DOCUMENTS 755,569 A * 3/1904 Freeland ..... 81/57.32
1,708,147 A * 4/1929 Miller ..... 81/13
2,375,270 A * 5/1945 Yonkers ..... 81/57.32
3,557,644 A * 1/1971 Gregory ..... 81/57.39
3,789,707 A * 2/1974 Belknap ..... 81/57.39
4,339,969 A * 7/1982 Hage ..... 81/57.39
4,718,315 A * 1/1988 Nitschmann ..... 81/58.2
6,666,113 B1 * 12/2003 Bravo ..... 81/111

* cited by examiner

*Primary Examiner*—Hadi Shakeri
(74) *Attorney, Agent, or Firm*—Robert M. Downey, PA

(57) ABSTRACT

An open-end ratchet wrench includes a housing defining a handle and a head with an open mouth for receiving first and second elements of a work piece therein. A fixed jaw member on the wrench engages the first element and a moving jaw member engages the second element of the work piece. A squeeze lever is operable to rotate the moving jaw member about a center axis of rotation selectively in either a clockwise or counterclockwise movement, to thereby tighten or loosen the second element relative to the first element. An engagement assembly operates the moving jaw member between an operable position in engagement with the work piece and a retracted position, wherein the jaw member moves away from the center axis of rotation to back off and release from operative engagement with the second element, thereby allowing removal of the wrench from the work piece.

5 Claims, 18 Drawing Sheets

OPEN END RATCHET WRENCH

BACKGROUND OF THE INVENTION

1. Field of the Invention

The present invention relates to wrenches, and more particularly, to an open-end reversible ratchet wrench operable by squeezing a lever to rotate a moving jaw relative to a fixed jaw in order to tighten or loosen a first hex nut member of a work piece while holding a second hex nut member on the work piece stationary.

2. Discussion of the Related Art

Open-ended wrenches are well known and typically include a single jaw and an elongate handle integral with the jaw. An open mouth is usually positioned at a slight angle in relation to the handle and is specifically sized for receiving a work piece therein for congruent engagement with the jaw in a manner which allows rotation of the work piece upon applying torque using the handle. Most open-end wrenches are specifically structured for grasping a multi-sided element, such as a hex nut configuration, on the work piece.

Use of a conventional open-end wrench to tighten or loosen a single element, such as a hex nut, is a fairly simple task, particularly if the hex nut is easily accessible. However, there are instances wherein it is required to manipulate (e.g. tighten or loosen) one element of a work piece relative to a second and independent element. For example, a router used in woodworking, such as in the making of cabinets and furniture, is typically equipped with a collet which has a fixed member and a rotatable member. The fixed member and rotatable member are provided with an exterior hex nut configuration. When a router bit is placed within the collet, the rotatable collet member is rotated in one direction relative to the fixed collet member in order to tighten the collet so that the router bit is held securely within the collet during use of the router. When it is desired to remove the router bit from the collet, the rotatable collet member is turned in the opposite direction to loosen the collet. Tightening or loosening the collet is usually accomplished with the use of two separate open-end wrenches. In fact, Porter Cable Corporation, a large manufacturer of routers, usually provides a pair of open-end wrenches with each new router. Use of two independent conventional open-end wrenches, such as those provided by router manufacturers, for tightening and loosening the router collet, can be awkward and clumsy. To tighten or loosen the collet, most router users place the two wrenches on the collet so that the handles are offset or angled relative to one another. The handles of the wrenches are then urged together, into alignment, causing the rotating collet member to turn in the desired direction in order to tighten or loosen the collet. The awkward action of applying force to the handles of the two separate wrenches, while maintaining the wrenches on the separate hex members of the collet has frustrated even the most experienced router user. While some people use two hands to manipulate the separate wrenches, others prefer to use one hand while squeezing the two wrench handles towards one another to tighten or loosen the collet. Despite the particular method used, it is not uncommon for one or both wrenches to become dislodged when applying simultaneous opposing forces to the independent wrench handles. When this happens, the fingers can sometimes become pinched between the two wrench handles.

In view of the foregoing, there remains a need for an open-end wrench which is particularly adapted for tightening and loosening the collet of a router with relative ease.

And, while tightening and loosening the collet of a router is one example of the need and usefulness of the present invention, it is important to note that the open-end ratchet wrench disclosed herein has useful applications in other environments wherein it is necessary to rotatably manipulate one element of a work piece relative to a second element of the work piece.

In the past, others have proposed various open-end ratchet wrenches which typically include a rotatable nut-engaging jaw which has an open mouth extending from its periphery to a nut-engaging opening. In order to permit rotation in one direction and block rotation in the opposite direction, a ratchet is provided on the wrench for driving engaging the jaw. In many instances, the ratchet cooperates with ratchet pawls which engage the ratchet. Examples of open-end ratchet wrenches are disclosed in the following U.S. Patents: Stanton, U.S. Pat. No. 5,456,143; Sroka, U.S. Pat. No. 5,388,479; Gamble, U.S. Pat. No. 5,768,958; and Ashby, U.S. Pat. No. 5,467,672. And, while the relevant art is crowded with open-end ratchet wrenches of various structural design and function, there remains a need for an open-end reversible ratchet wrench which includes two independent jaw members, including a moving jaw member and a fixed jaw member, and wherein the wrench is designed to tighten or loosen a first hex nut member relative to a second hex nut member of a work piece. There is a further need for an open-end reversible ratchet wrench which includes a moving jaw member and a fixed jaw member, and wherein the moving jaw member is rotated, in either direction, by squeezing a lever extending from the side of the handle of the wrench. There is yet a further need for an open-end reversible ratchet wrench having a moving jaw member and a fixed jaw member, and wherein the moving jaw member is adapted for linear movement towards and away from a central axis of rotation, thereby allowing the moving jaw member to back off and release from operative engagement with the work piece so that the wrench can be removed from the work piece.

SUMMARY OF THE INVENTION

The invention disclosed herein is directed to an open-end ratchet wrench for turning a first element of a work piece while simultaneously holding another element of the work piece in fixed position. The open-end ratchet wrench includes a housing which is shaped and configured to form a handle and a head with an open mouth for receiving the work piece therein. A fixed jaw member at the base of the mouth engages one element of the work piece while a moving jaw member within the mouth engages a second element of the work piece. A lever extending from the handle is squeezed and released in order to operatively rotate the moving jaw member about a center axis of rotation selectively in either a clockwise or counterclockwise movement, thereby turning the second element of the work piece relative to the first element. An engagement and release assembly operates the moving jaw member between an operable position in engagement with the work piece and a retracted position, wherein the jaw member moves away from the center axis of rotation to back off and release from operative engagement with the second element, thereby allowing removal of the wrench from the work piece.

OBJECTS AND ADVANTAGES OF THE INVENTION

It is a principal object of the present invention to provide an open-end ratchet wrench for holding one element of a work piece in fixed position while simultaneously turning a second element of the work piece relative to the first element, and wherein the wrench is operable by squeezing and releasing a lever.

It is still a further object of the present invention to provide an open-end ratchet wrench which is operable with the use of one hand by squeezing a lever to rotate a moving jaw member relative to a fixed jaw member, thereby turning one element of a work piece while holding another element of a work piece in fixed position.

It is still a further object of the present invention to provide an open-end ratchet wrench which is operable by squeezing a lever, thereby providing for ease of use in confined spaces wherein it is difficult to reach and manipulate a work piece using a conventional wrench.

It is still a further object of the present invention to provide an open-end ratchet wrench which performs the function of two independent conventional open-end wrenches with the use of one hand and without the need for any extraordinary skill or expertise.

It is yet a further object of the present invention to provide an open-end ratchet wrench which is adapted for easily tightening and loosening the collet of a router while operating the wrench with the use of a single hand.

It is yet a further object of the present invention to provide an open-end ratchet wrench which is operable by squeezing a lever extending from a handle of the wrench, and wherein the wrench includes a fixed jaw member and a rotating jaw member, and further wherein the wrench is structured to provide for ease of placement of the wrench on a work piece and removal of the wrench from the work piece.

These and other objects and advantages of the present invention are more readily apparent with reference to the following details description and accompanying drawings.

BRIEF DESCRIPTION OF THE DRAWINGS

For a fuller understanding of the nature of the present invention, reference should be made to the following detailed description taken in conjunction with the accompanying drawings in which:

FIGS. 3*a*–9*a* show a top plan view of the wrench, with a top plate of the wrench housing removed, illustrating a jaw engagement and disengagement assembly operating in conjunction with the ratcheting jaw rotation assembly in accordance with the sequence of operational movements depicted in FIGS. 3–9;

Like reference numerals refer to like parts throughout the several views of the drawings.

DETAILED DESCRIPTION OF THE PREFERRED EMBODIMENT

Figure 1:
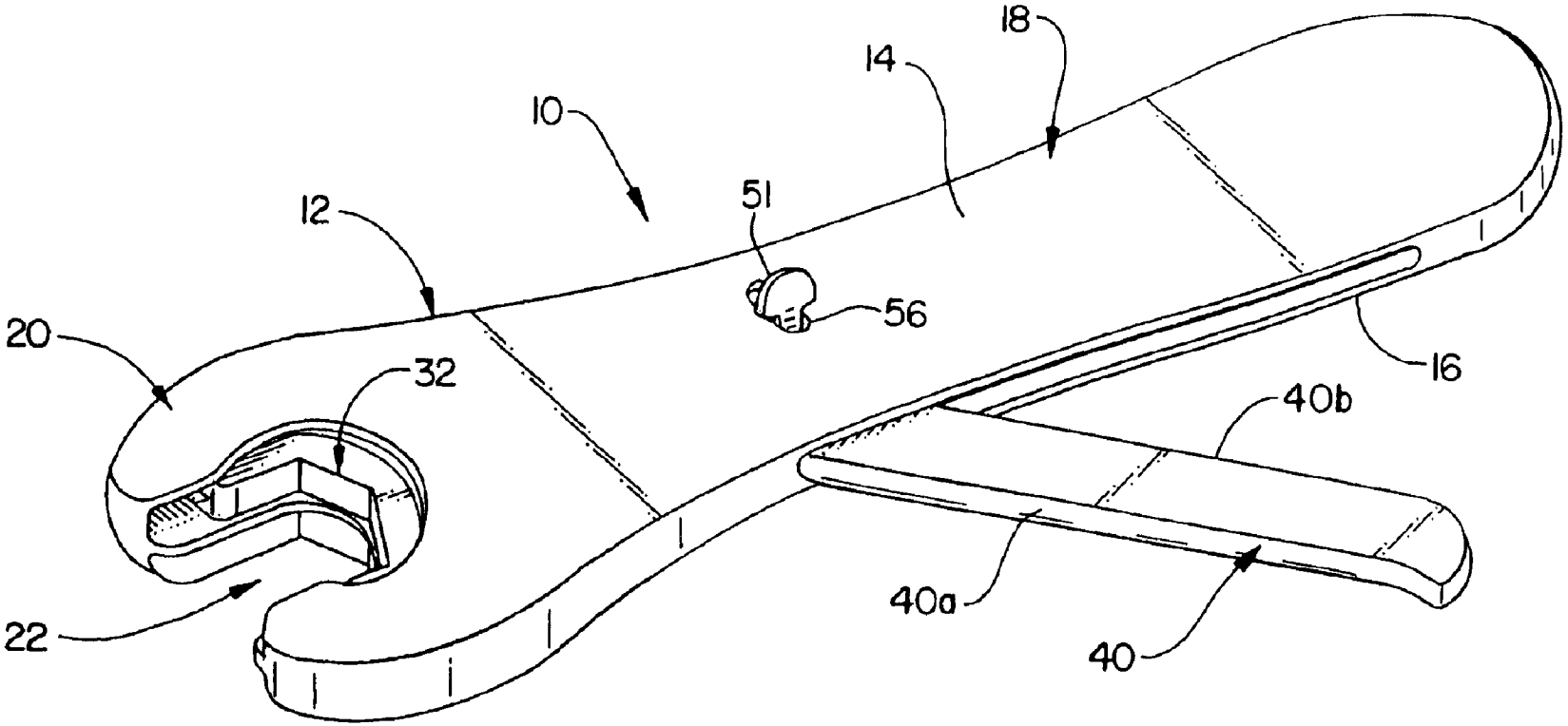
FIG. 1 is a top perspective view of the open-end ratchet wrench of the present invention, shown with the squeeze lever in a relaxed position, in accordance with a preferred and practical embodiment.
Figure 2:
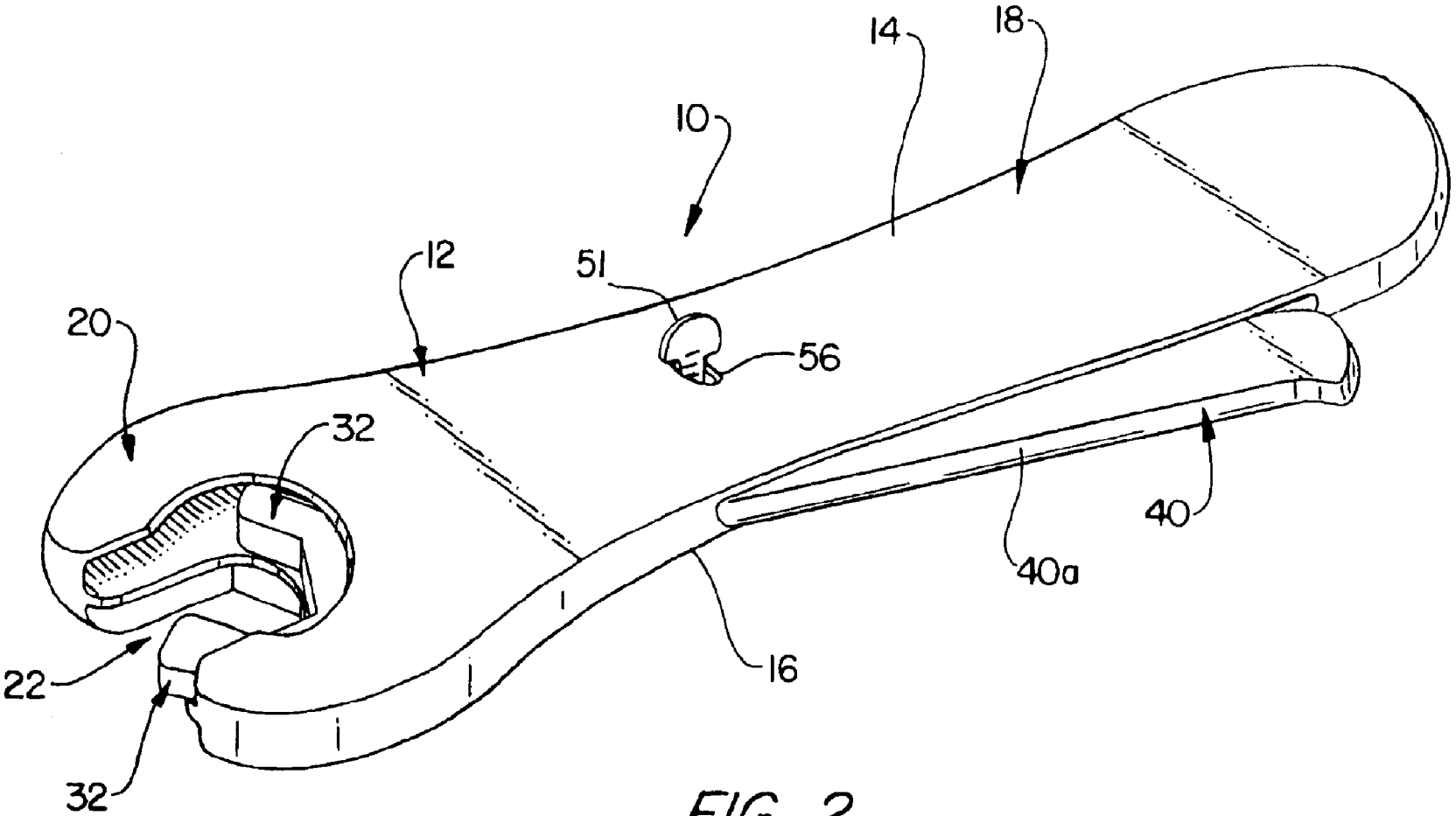
FIG. 2 is a top perspective view of the wrench of FIG. 1, shown with the lever squeezed towards the handle during operation of the wrench, to thereby rotate a moving jaw member relative to a fixed jaw member and about a central axis of rotation.
Figure 10:
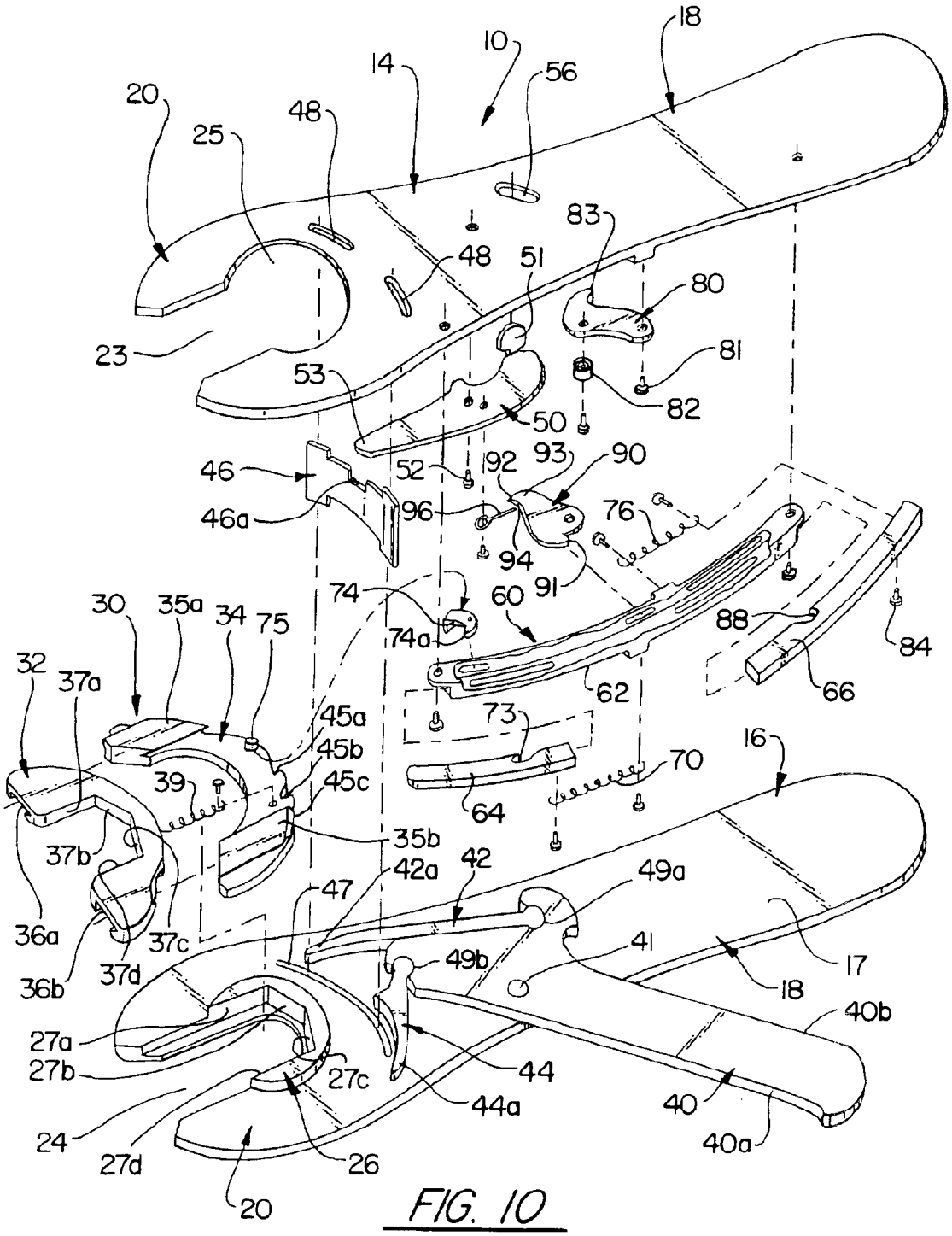
FIG. 10 is an exploded perspective view of the open-end ratchet wrench illustrating the principal components thereof.

Referring to the several views of the drawings, and initially FIGS. 1, 2 and 10, the open-end ratchet wrench of the present invention is shown and is generally indicated as 10. The wrench 10 includes a housing 12 defined primarily by a top plate 14 and an opposing bottom plate 16. In the preferred embodiment, the top and bottom plates are formed as a one-piece integral unit, as seen in FIGS. 1 and 2, wherein the periphery joining the top and bottom plates is partially closed to conceal many of the mechanical components, as described more fully hereinafter.

The housing 12, including the top and bottom plates 14, 16, is formed and configured to provide an elongate handle 18 and an integral head 20. The head 20 is formed and configured to provide an open mouth 22. Specifically, the top plate 14 includes an open-end channel 23 extending to an enlarged circular opening 25, and the bottom plate 16 is provided with an elongate open-end channel 24. The channel 23 and opening 25 of the top plate are positioned in corresponding alignment with the elongate open-end channel 24 on the bottom plate and, in conjunction, define the open mouth 22.

A fixed jaw member 26 is integrally formed on the inner side surface 17 of the bottom plate 16 at the base of the elongate channel 24. Specifically, the fixed jaw member 26 is raised from the inner surface 17 of the bottom plate and surrounds the base of the elongate channel 24 in a generally C-shaped configuration. The fixed jaw member 26 is provided with an arrangement of angled flat surfaces 27*a*–27*d* for congruent engagement with an outer hex nut configuration of a first element of a work piece therein.

A moving jaw assembly 30 is operable in relation to the fixed jaw member 26 and includes a moving jaw member 32 and a carriage 34. The moving jaw member 32 is slidably coupled to the carriage 34 by dovetail members 35*a* and 35*b* which are received within correspondingly aligned and congruently configured slots 36*a* and 36*b* formed on the underside of the moving jaw member 32. The moving jaw member is provided with an arrangement of angled surfaces 37*a*–37*d* for congruent receipt and engagement with a hex nut configuration on a second element of the work piece.

Figure 11:
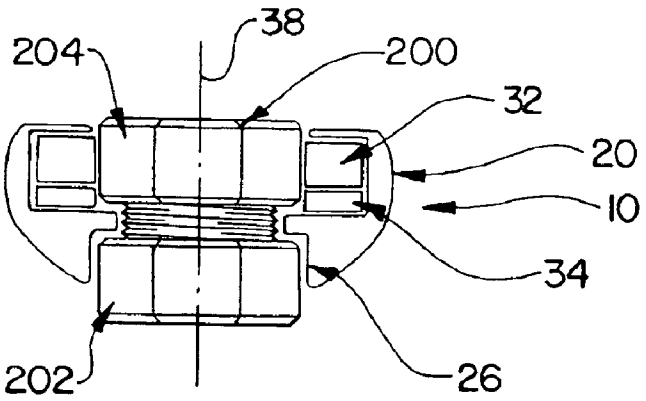
FIG. 11 is a front-end elevational view showing the open-end ratchet wrench operatively positioned on a work piece.
Figure 12:
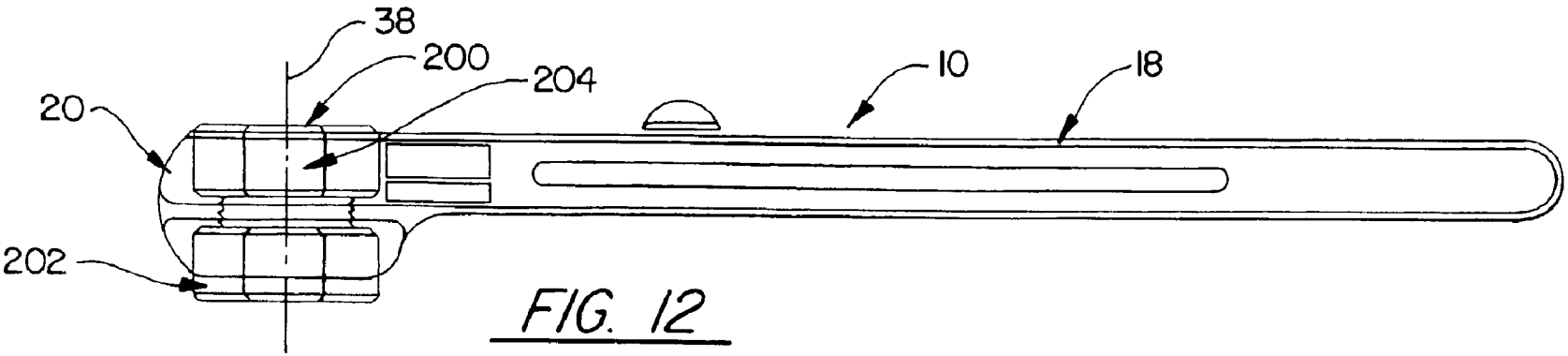
FIG. 12 is a side elevational view of the open-end ratchet wrench positioned on the work piece.

A spring 39 attached between the moving jaw 32 and carriage 34 maintains tension on the jaw 32 to urge the jaw 32 onto the carriage 34, by sliding on the coupled arrangement of the dovetail members 35*a*–*b* and corresponding slots 36*a*–*b*. When the jaw 32 is pulled onto the carriage by spring 39, the jaw 32 is retracted or backed-off from the open mouth and the work piece. Accordingly, the jaw member 32 is slidably moveable on the carriage 34, in a linear action, between an operable position to engage the second element of the work piece and a retracted position wherein the jaw member 32 is moved away from a central axis of rotation 38 in order to back off and release from operable engagement with the work piece, thereby allowing removal of the tool 10 from the work piece. When the jaw member 32 is operatively engaged with the second element of the work piece, the jaw member 32 can be selectively rotated about the central axis 38 in order to apply torque on the second element, thereby turning the second element relative to the first element of the work piece. It should be noted that when the work piece is operatively received within the grasp of the fixed jaw member 26, at the base of the mouth 22 of the wrench, the central rotational axis 38 of the wrench is in axial alignment with the rotational axis of the first and/or second elements of the work piece. The wrench 10 may be used on a work piece wherein both the first element and the second element of the work piece are able to rotate. In other applications, only one element of the work piece may be able to rotate while the other element remains fixed. An example of a work piece having one element rotatable in relation to a fixed element for operative manipulation by the wrench 10 of the present invention is a collet of a router used in woodworking. Referring to FIGS. 11 and 12, the wrench 10 is shown in operative engagement with a collet 200 of a router, wherein the fixed jaw member 26 is engaged with a fixed hex nut member 202 on the collet and the moving jaw member 32 is operatively engaged with a rotating hex nut member 204 on the collet. In this particular application, the rotating hex nut member 204 is selectively rotated in either a clockwise or a counterclockwise direction relative to the fixed hex nut member to tighten or loosen the collet about a router bit (not shown) placed within the collet.

It should be noted, however, that the wrench 10 is useful in other applications wherein it is necessary to rotatably manipulate a first member relative to a second member of a work piece and, accordingly, use of the wrench 10 is not intended to be limited to tightening or loosening a collet of a router.

As described above, the jaw member 32 on the moving jaw assembly 30 is moveable in two distinct actions relative to the fixed jaw member 26 and the work piece (e.g. router collet). Specifically, the jaw moving member 32 is selectively moveable, in a rotating action, in either a clockwise direction or counterclockwise direction about the central axis of rotation 38. This rotating action of the jaw member 32 serves to rotatably manipulate the second element of the work piece relative to the first element of the work piece, while the fixed jaw member 26 holds the first element. The jaw member 32 is also moveable in a linear action, towards and away from the central axis of rotation 38. Specifically, the jaw member 32 is slidably moveable on the carriage 34 towards the central axis of rotation 38 to operatively engage the second element of the work piece. This allows the angled surfaces 37*a–d* of the jaw member 32 to engage with the multi-sided hex nut configuration of the second element of the work piece. Once in this position, the jaw member 32 can be rotated about the central axis of rotation 38 to rotatably manipulate the second element of the work piece. When it is desired to remove the wrench 10 from the work piece, the jaw member 32 must first be released from the second element. To do this, the jaw member 32 is moved to the retracted position, away from the central axis of rotation 38, so that the angled surfaces 37*a–d* release from operative engagement with the outer hex nut configuration of the second element of the work piece. With the jaw member 32 in the retracted position (i.e. backed off from the second element of the work piece) the fixed jaw member 26 can be released from the first element of the work piece as the wrench is removed and the work piece exits the open mouth without obstruction.

Rotating movement of the moving jaw assembly 30 is accomplished by operation of a ratcheting jaw rotation assembly. Specifically, the ratcheting jaw rotation assembly serves to selectively rotate the jaw member 32 and carriage 34, in unison, in either the clockwise direction or counterclockwise direction about the central rotational axis 38. Rotating, ratcheting movement of the jaw rotation assembly is accomplished by operation of lever 40 about a pivot axis 41. More specifically, the operating lever 40 is pivotally secured to the wrench housing 12 by pivot pin 41 and is operable between a relaxed position (see FIG. 1) wherein the lever 40 extends outwardly from the handle 18, and a compressed position (see FIG. 2) wherein the lever 40 is moved inwardly towards the handle 18. Movement of the operating lever 40 between the relaxed position and the compressed position is achieved by applying squeezing pressure to the outer side edge 40*a* of the lever 40 while holding the handle 18 of the wrench in one hand. As the operating lever 40 is squeezed to the compressed position, the inner edge 40*b* moves into the housing 12 and between the top plate 14 and bottom plate 16.

As best seen in FIGS. 3–9, the ratcheting jaw rotation assembly further includes a right finger 42 and a left finger 44. The right finger 42 and left finger 44 are moveably coupled to the inner end of the operating lever 40, within circular sockets 49*a* and 49*b*, respectively. Accordingly, the fingers 42,44 remain attached to the lever 40, but are able to pivot through a limited range of movement relative to the lever 40. Upon operation of the lever 40 from the relaxed position to the compressed position, the right and left fingers 42, 44 are urged forwardly towards the moving jaw assembly 30. An arrangement of spaced notches 43*a–c* are provided on the carriage 34 for operative engagement with the distal tip 42*a* of the right finger 42. Similarly, an arrangement of spaced notches 45*a–c* are provided on the carriage 34 for operative engagement with the distal tip 44*a* of the left finger 44. An arcuate shield 46 is slidably fitted between the top plate 14 and bottom plate 16 for selectively blocking engagement of either the distal tip 42*a* of the right finger 42 with the carriage 34 or the distal tip 44*a* of the left finger 44 with the carriage 34. Specifically, the arcuate shield 46 is slidable within an arcuate slot 47 on the bottom plate 16 and spaced slots 48 on the top plate 14. A pivoting switch 50 is pivotally attached to the top plate by pivot pin 52 and is moveable, in a pivoting action, by applying pressure to thumb plate 51 extending through slot 56 on the top plate 14 of the housing. A distal end 53 of the pivoting switch 50 is positioned within a notch 46*a* formed in the top center of the arcuate shield 46. Upon selective operation of the pivoting switch 50 about the pivot pin 52, the distal end 53 moves to the right or to the left to move the arcuate shield 46 in order to allow subsequent rotation of the moving jaw assembly in either the clockwise direction or the counterclockwise direction. For instance, when the pivoting switch 50 is operated to move the distal end 53 to the right, causing sliding movement of the arcuate shield 46 towards the right finger 42, the arcuate shield 46 forms a barrier between the distal tip 42*a* of the right finger 42 and the spaced notches 43*a–c* on the carriage 34. In this position, the arcuate shield 46 is moved out of blocking position between the left finger 44 and the carriage, thereby allowing the distal tip 44*a* to be operatively received, in sequential operation, within the respective notches 45*a–c*. Accordingly, upon squeezing and relaxing the lever 40 in a sequence of operation, the left finger 44 is caused to move into successive engagement with the respective spaced notches 45*a–c*.

Figure 3:
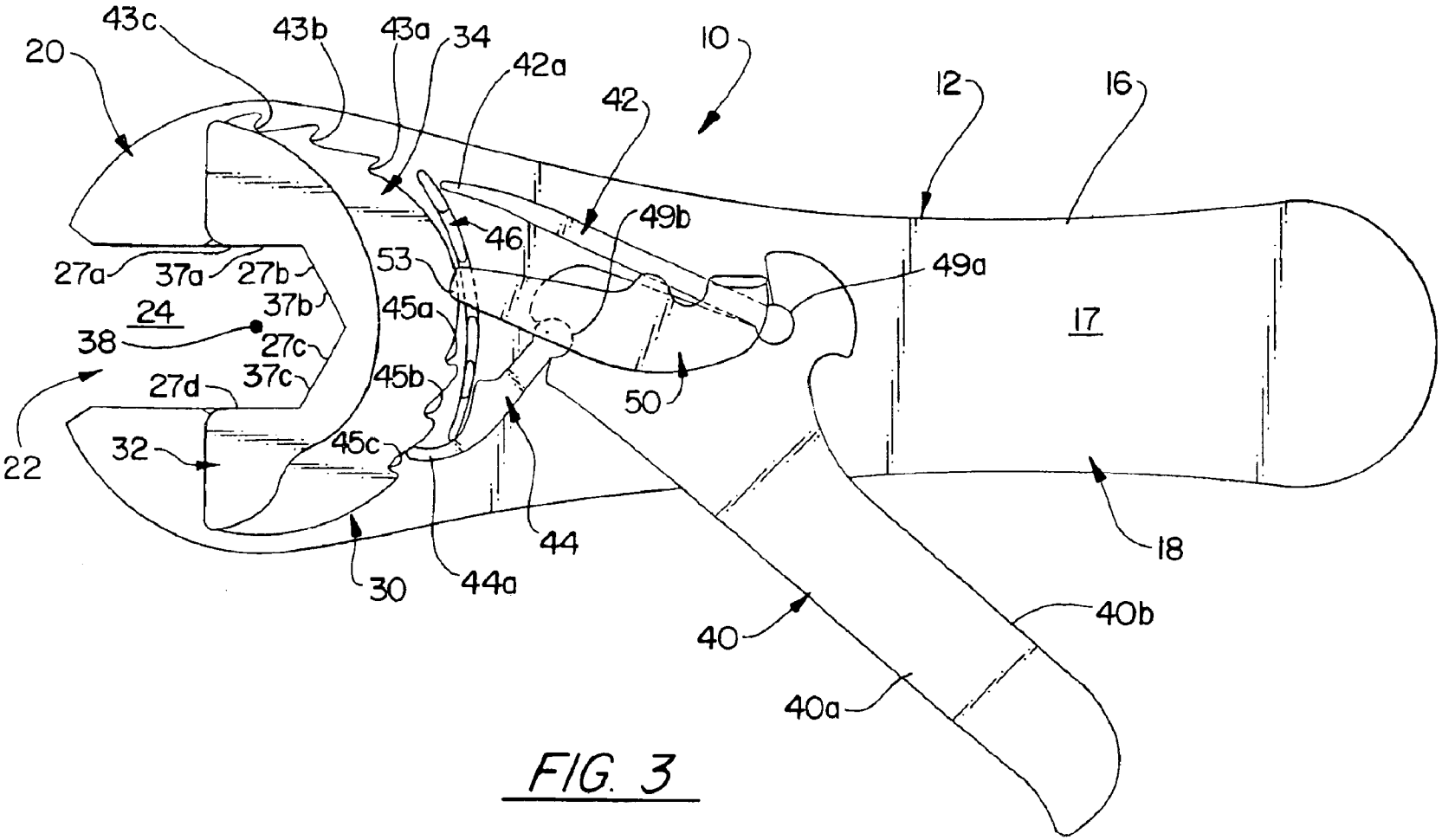
FIGS. 3–9 show a top plan view of a portion of the wrench illustrating a sequence of operational movements of a ratcheting jaw rotation assembly to rotate a moving jaw through a series of rotational movements in both a clockwise and counterclockwise direction about a central axis of rotation.
Figure 4:
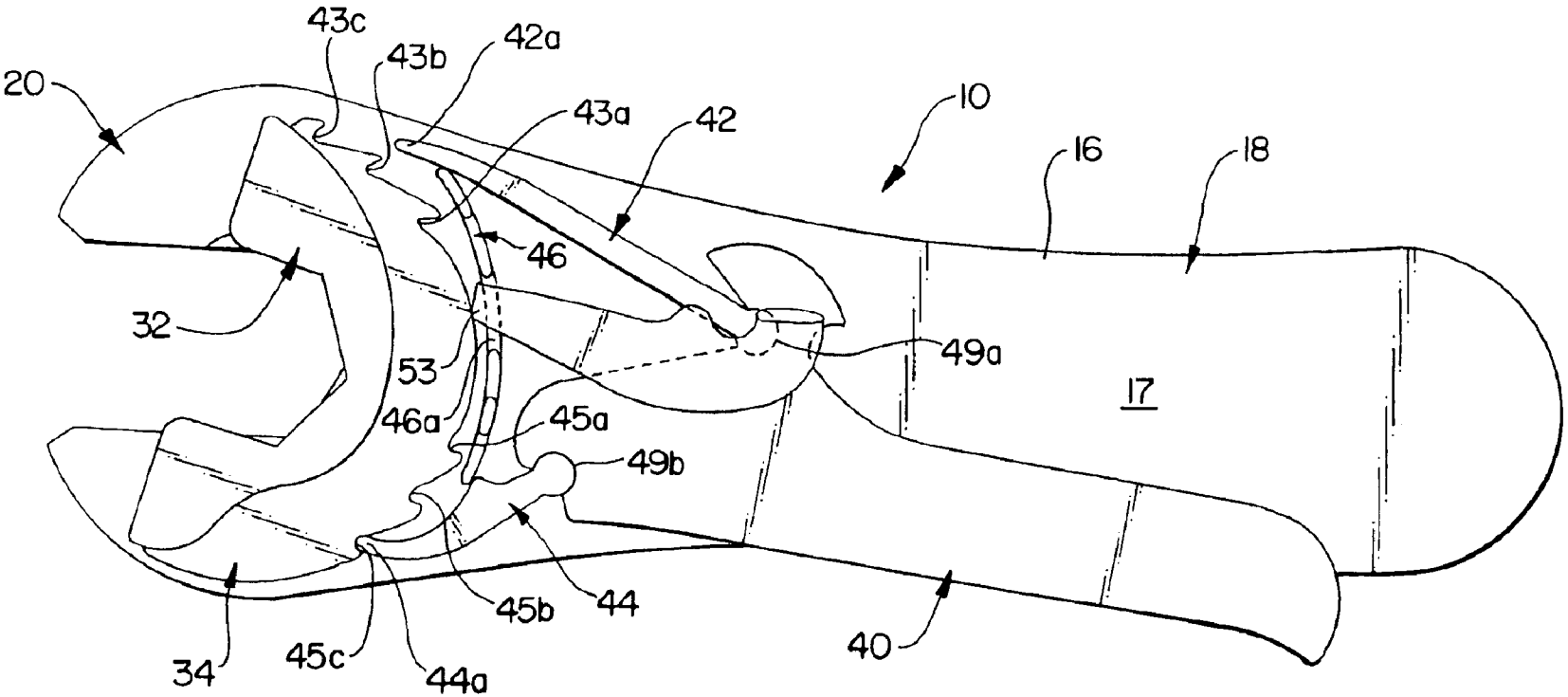
Figure 4A:
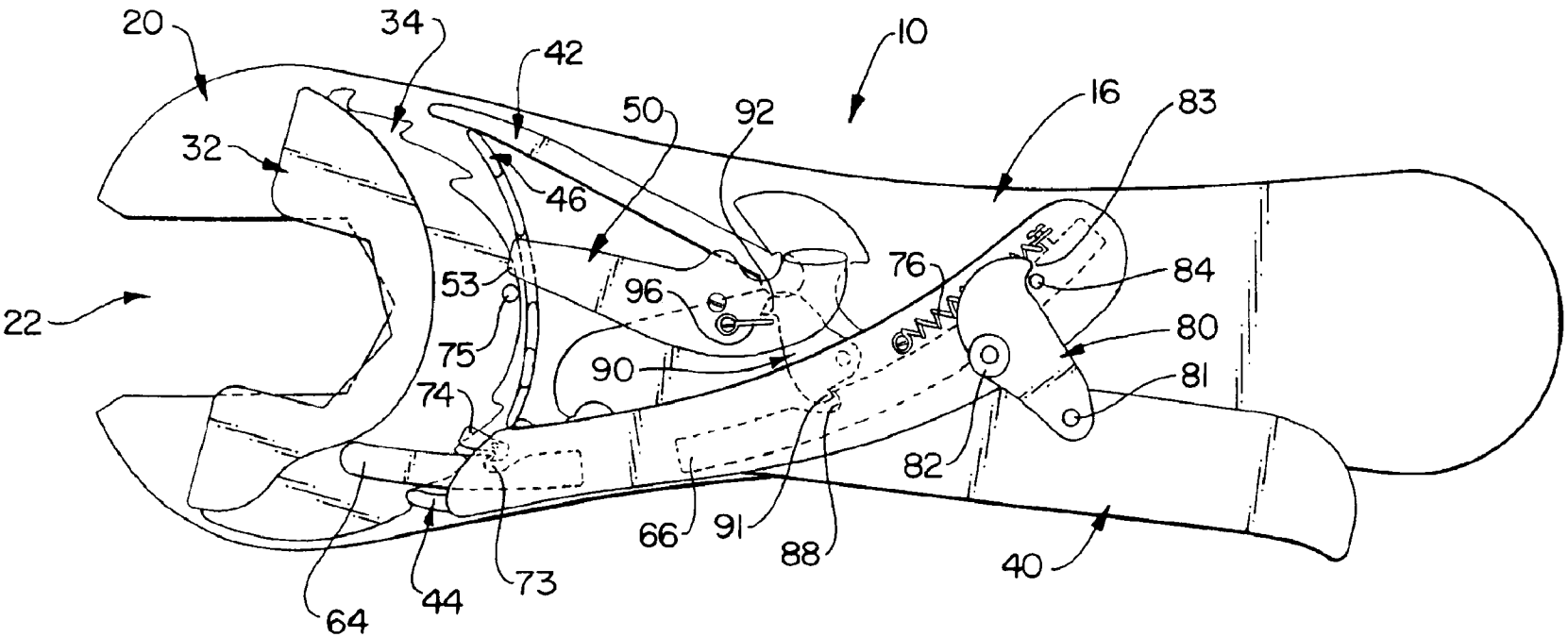
Figure 5:
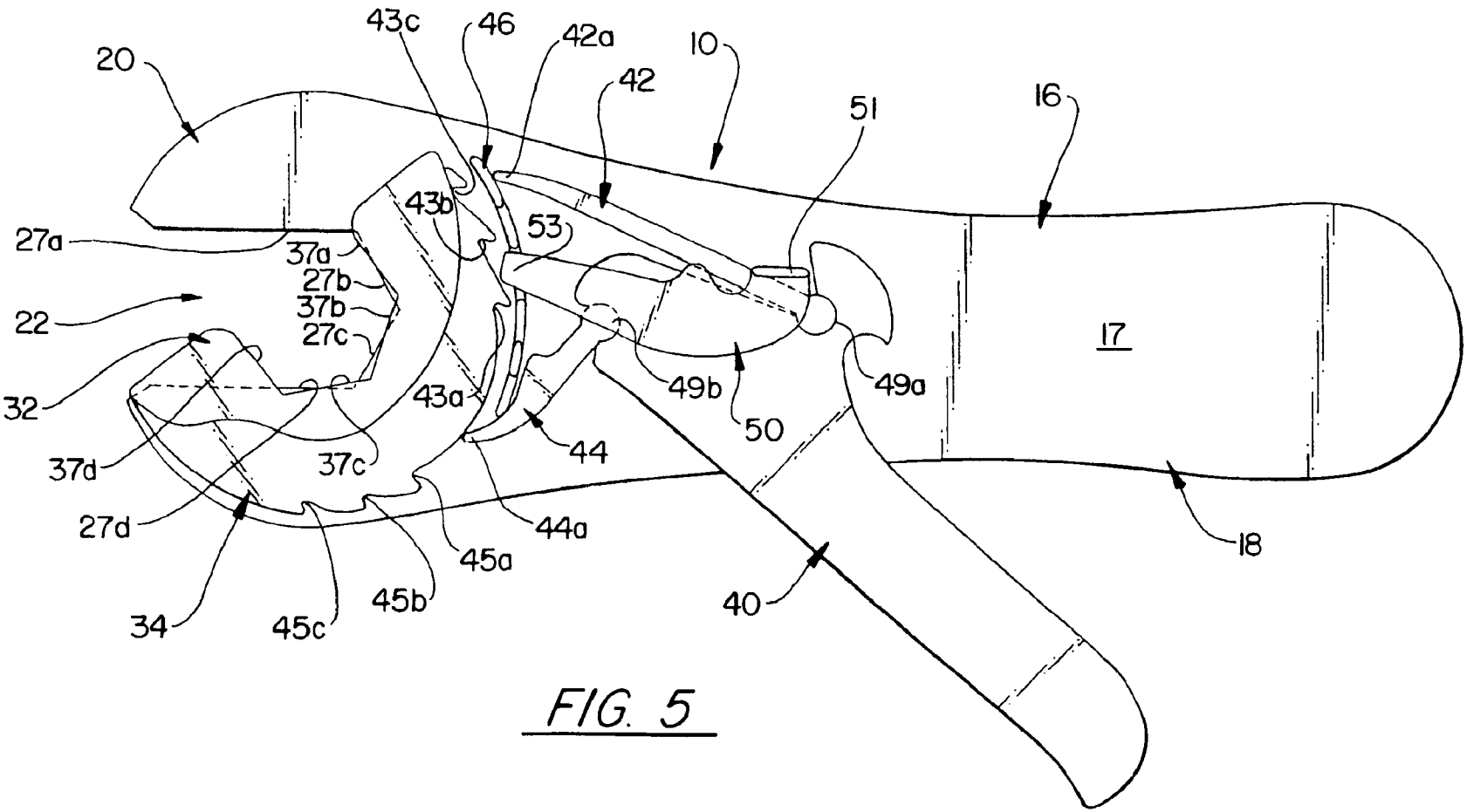
Figure 5A:
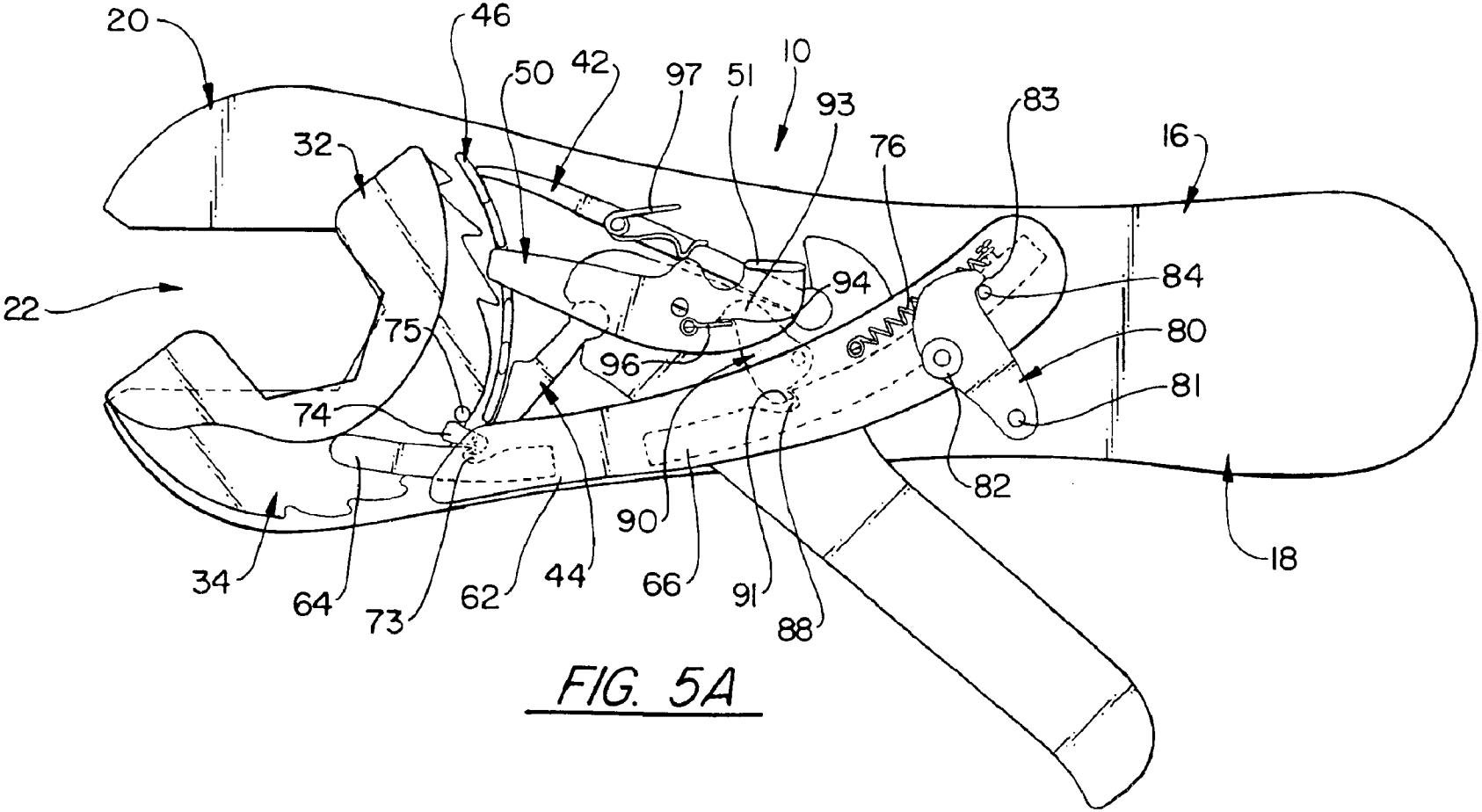
Figure 6:
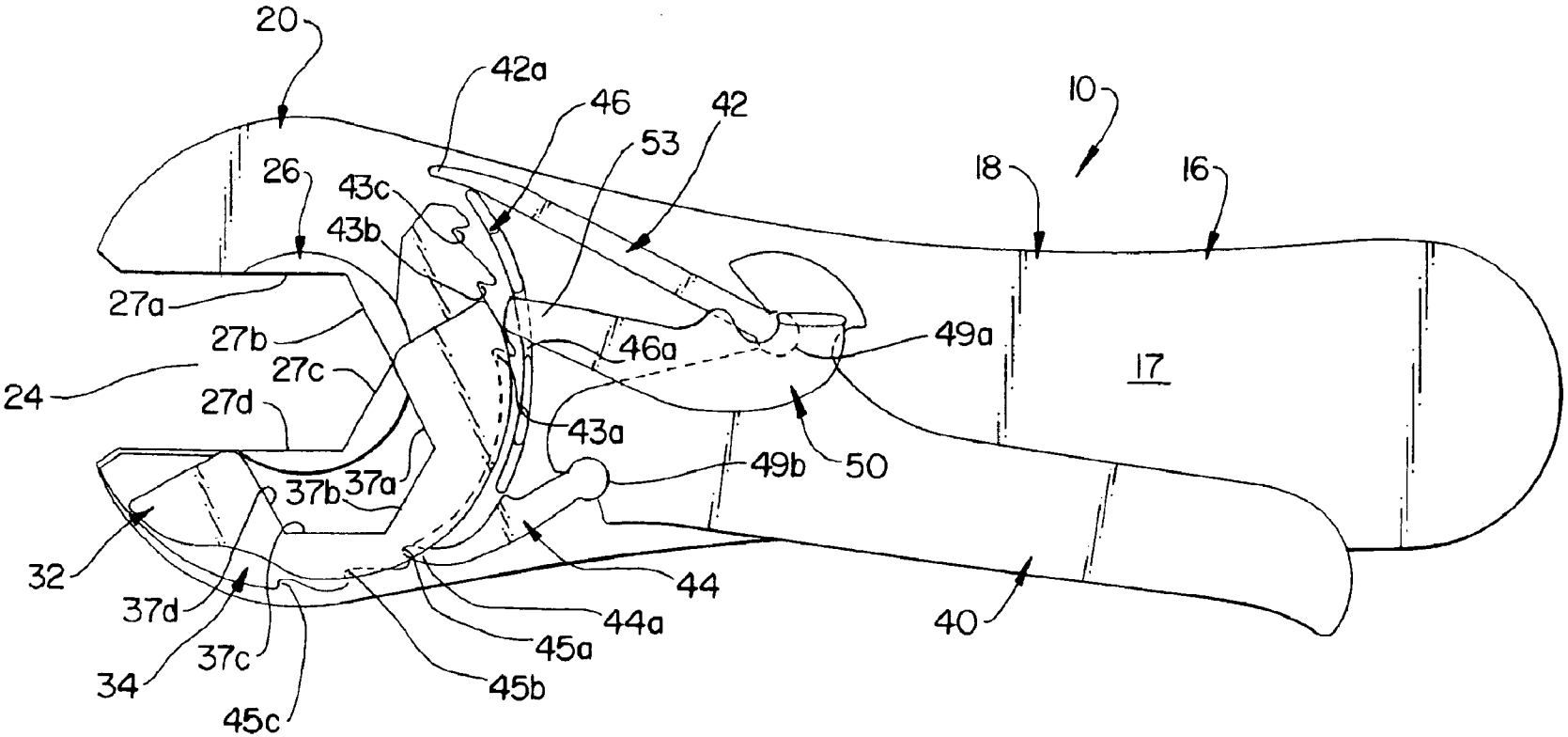
Figure 6A:
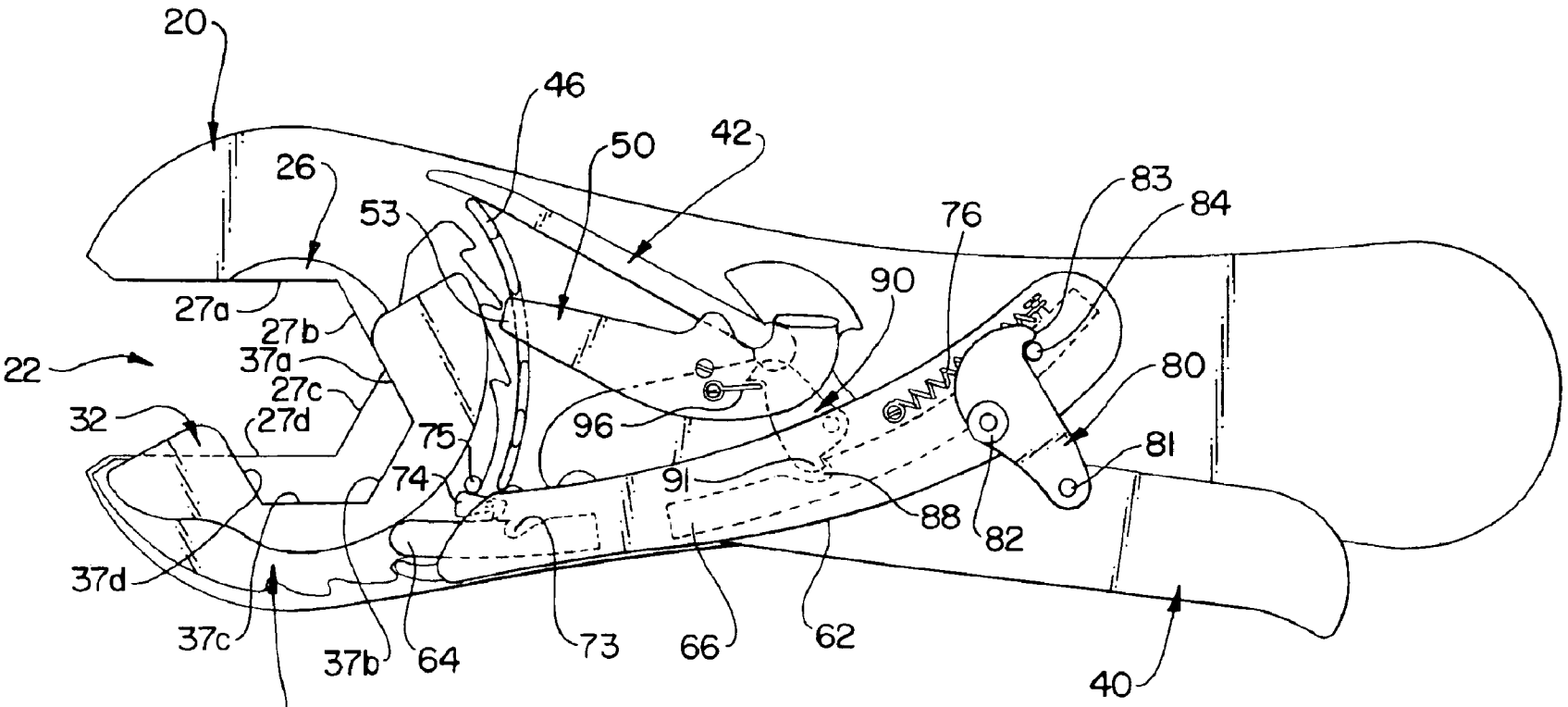

As illustrated in FIGS. 3–7, the arcuate shield 46 is moved to the right, in blocking relation to the right finger 42. Beginning at a starting position, with the angled surfaces 37*a–d* of the jaw member 32 aligned with the angled surfaces 27*a–d* of the fixed jaw member 26, the operating lever 40 is squeezed from the relaxed state, as shown in FIG. 3, to the compressed position, as shown in FIG. 4, causing the distal tip 44*a* of the left finger 44 to be engaged within notch 45*c* on the carriage 34 to thereby push and rotate the moving jaw assembly 30 in the clockwise direction so that the jaw member 32 rotates relative to the fixed jaw member 26 and about the central axis of rotation 38. Subsequently, upon removing squeezing pressure on the lever 40, to allow the lever 40 to return to the relaxed state, the left finger 44 moves back to position the distal tip 44*a* into operative alignment with the next successive notch 45*b* on the carriage 34. Then, upon squeezing the lever 40 again to the compressed state, the distal tip 44*a* moves into engagement with the notch 45*b* to again rotate the moving jaw assembly 30 a further turn in the clockwise direction. Upon squeezing the lever 40 a third time, the distal tip 44*a* of the left finger 44 operatively engages the notch 45*a* to again rotate the moving jaw assembly 30, thereby completing a full range of rotational movement of the moving jaw assembly 30, and particularly the jaw member 32, in the clockwise direction from the starting position shown in FIG. 3. Upon reaching the final clockwise turn movement, wherein surface 27*b* on the fixed jaw member 26 is in parallel alignment with surface 37*a* on the moving jaw member 32, trip pin 75 hits pawl 74 to cause the moving jaw assembly 30 to retract and release from the work piece, as described more fully hereinafter.

Figure 3A:
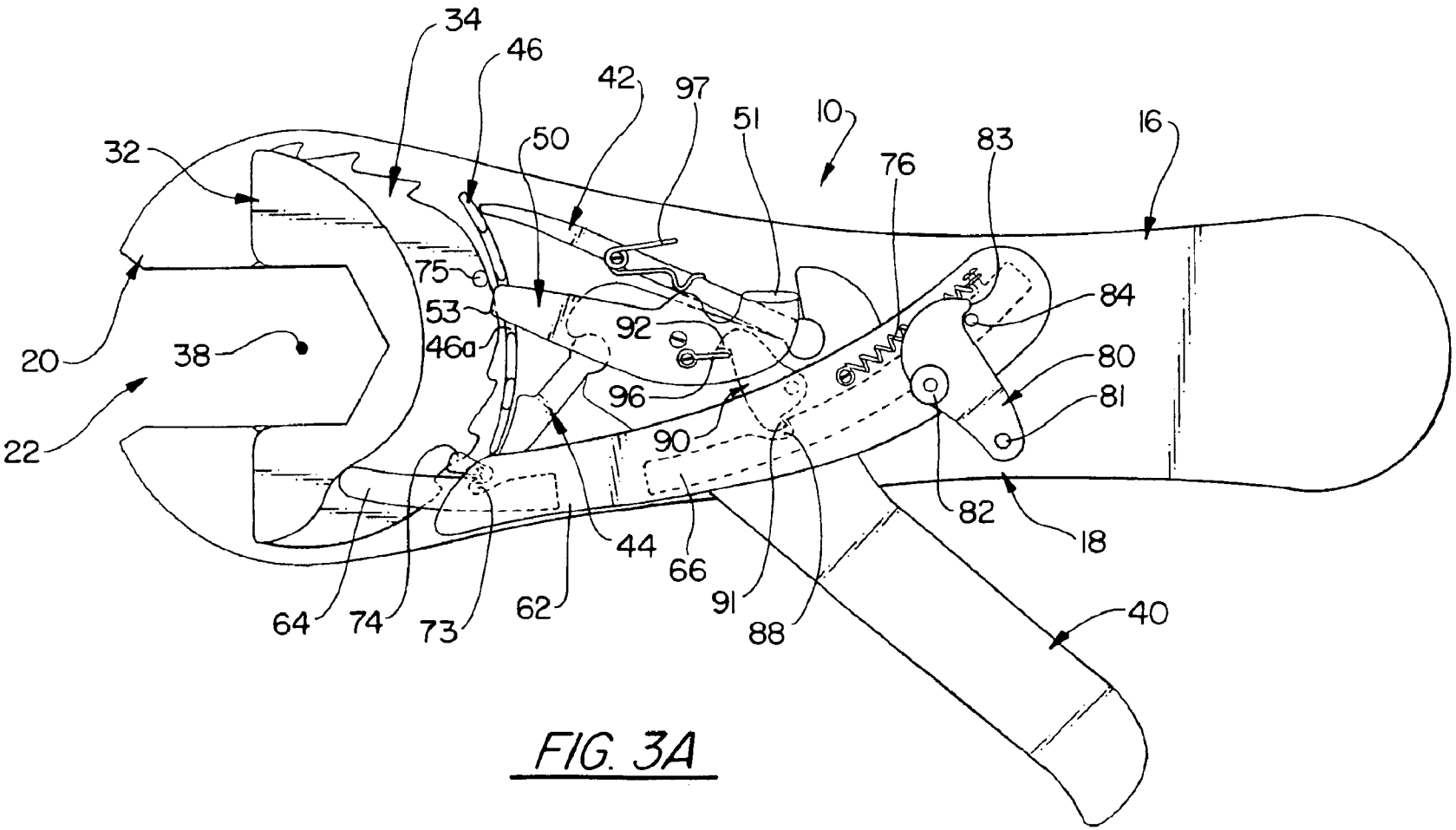

In order to reverse the rotational movement of the moving jaw assembly 30 in the counterclockwise direction, the pivoting switch 50 is operated, again using thumb plate 51 to slide the arcuate shield 46 to the left, in blocking relation between the left finger 44 and the carriage 34 so that the distal tip 44*a* of the left finger 44 does not engage within the notches 45*a*–45*c*. However, with the arcuate shield 46 moved to this left position, the distal tip 42*a* of the right finger 42 is able to engage notches 43*a*–43*c* on the carriage 34 upon operating the lever 40 in the manner described above. Specifically, upon squeezing and releasing the lever 40 in a successive operational action, the distal tip 42*a* of the right finger 42 sequentially engages the respective notches 43*a*–43*c*. Specifically, the distal tip 42*a* first engages notch 43*c* to rotate the moving jaw assembly 30 one turn movement in the counterclockwise direction. Successive squeezing and releasing operation of the lever 40 results in sequential engagement of the distal tip 42*a* within the notches 43*b* and 43*c* to eventually return the moving jaw assembly 30 to the start position, as seen in FIGS. 3 and 3*a*, wherein the angled surfaces 27*a*–27*d* on the fixed jaw member are in alignment with the respective angled surfaces 37*a*–37*d* on the moving jaw member 32. The moving jaw assembly 30 is rotated in the counterclockwise direction when it is either desirous to turn the second element of the work piece counterclockwise relative to the first element of the work piece, or when it is desirous to simply return the moving jaw assembly 30 to the start position, as seen in FIGS. 3 and 3*a*.

As described above, the moving jaw member 32 is slidably coupled to the carriage 34 and is moveable in a linear action to permit engagement and disengagement of the moving jaw member 32 from the work piece. Spring 39 urges the moving jaw member 32 to the retracted position onto the carriage 34, so that the moving jaw member 32 is backed off from the work piece and the central axis of rotation 38. A push bar assembly 60 operates to apply an opposing force on the moving jaw member 32, counteracting the spring 39, to move the jaw member 32 toward the central axis of rotation 38 and into operative engagement with the work piece. The push bar assembly 60 includes an elongate housing 62 containing a forward push bar segment 64 and a rear push bar segment 66. A spring 70 is attached to the forward push bar segment 64 and urges the forward push bar segment to a retracted position within the housing 62. The forward push bar segment 64 is pushed outwardly, from the forward end of the housing 62 by the rear push bar segment 66. More specifically, a spring 76 attached to the rear push bar segment 66 urges the rear push bar segment 66 forward, within the housing 62, and into engagement with the forward push bar segment 64. The force applied by the spring 76 is sufficient to overcome the retraction force of spring 70, to thereby force the forward push bar segment 64 outwardly from the housing to an extended position and into engagement with the moving jaw member 32. When the rear push bar segment forces the forward push bar segment 64 to the fully extended position, the forward push bar segment 64 applies sufficient force against the moving jaw member 32 to cause the jaw member 32 to slide forward, towards the central axis of rotation 38, as seen in FIGS. 3*a*–5*a* and FIGS. 8*a*–9*a*. When the forward push bar segment 64 is in the extended position, the pawl 74 engages notch 73 on the forward push bar segment to hold the forward push bar segment in the extended position, while the spring 70 is under tension. Meanwhile, the rear push bar segment 66 is normally held in a loaded or cocked position, as seen in FIGS. 3*a*–6*a* and FIG. 9*a*. In this loaded position, spring 76 is under tension, applying a force which urges the rear push bar segment 66 forward and into forced engagement with the forward push bar segment. Pawl 90 is used to hold the rear push bar segment 66 in the loaded position. Specifically, a hook portion 91 on the pawl 90 engages notch 88 on the rear push bar segment 66 to hold the rear push bar segment in the loaded position, with tension on spring 76.

Figure 7:
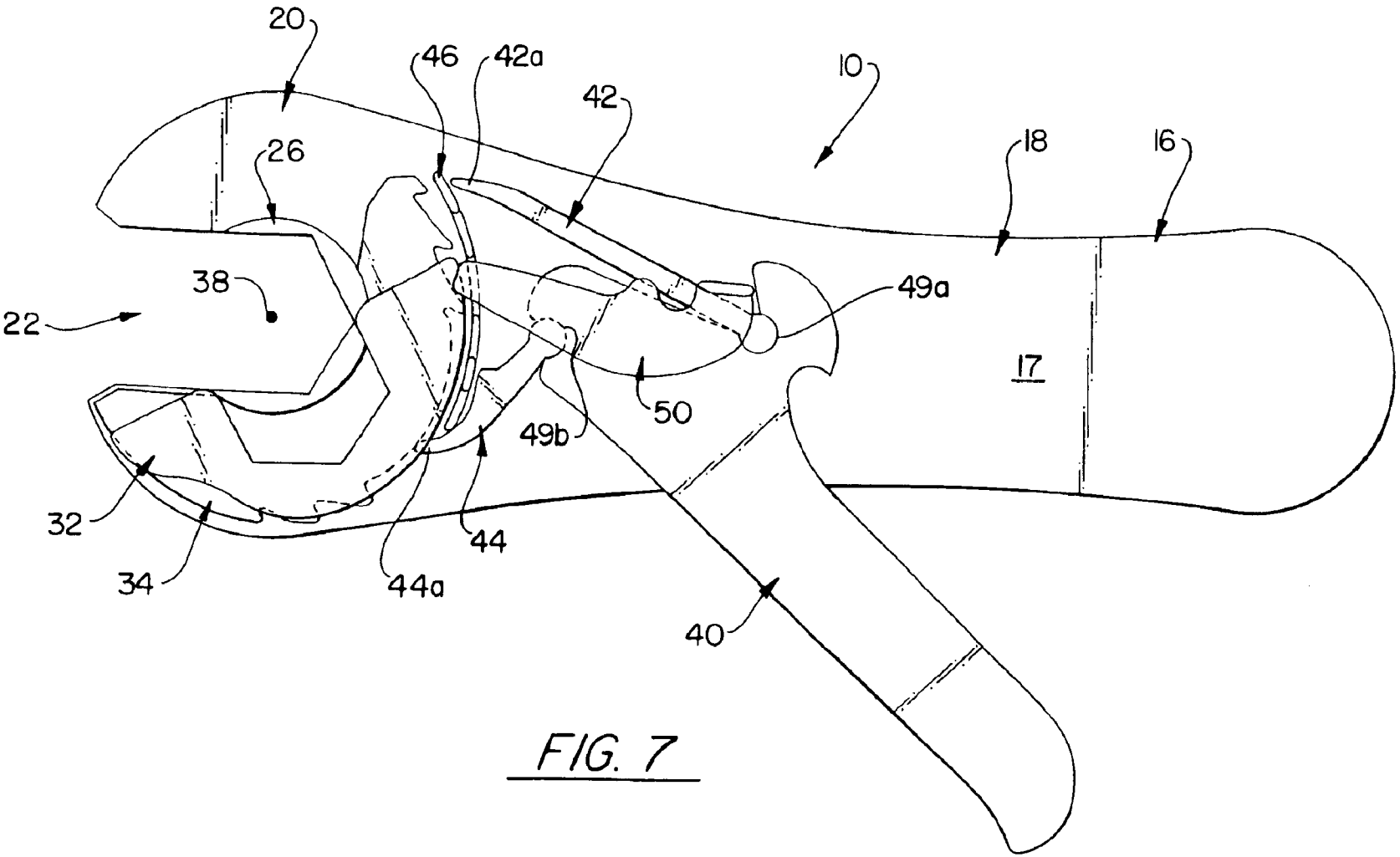
Figure 7A:
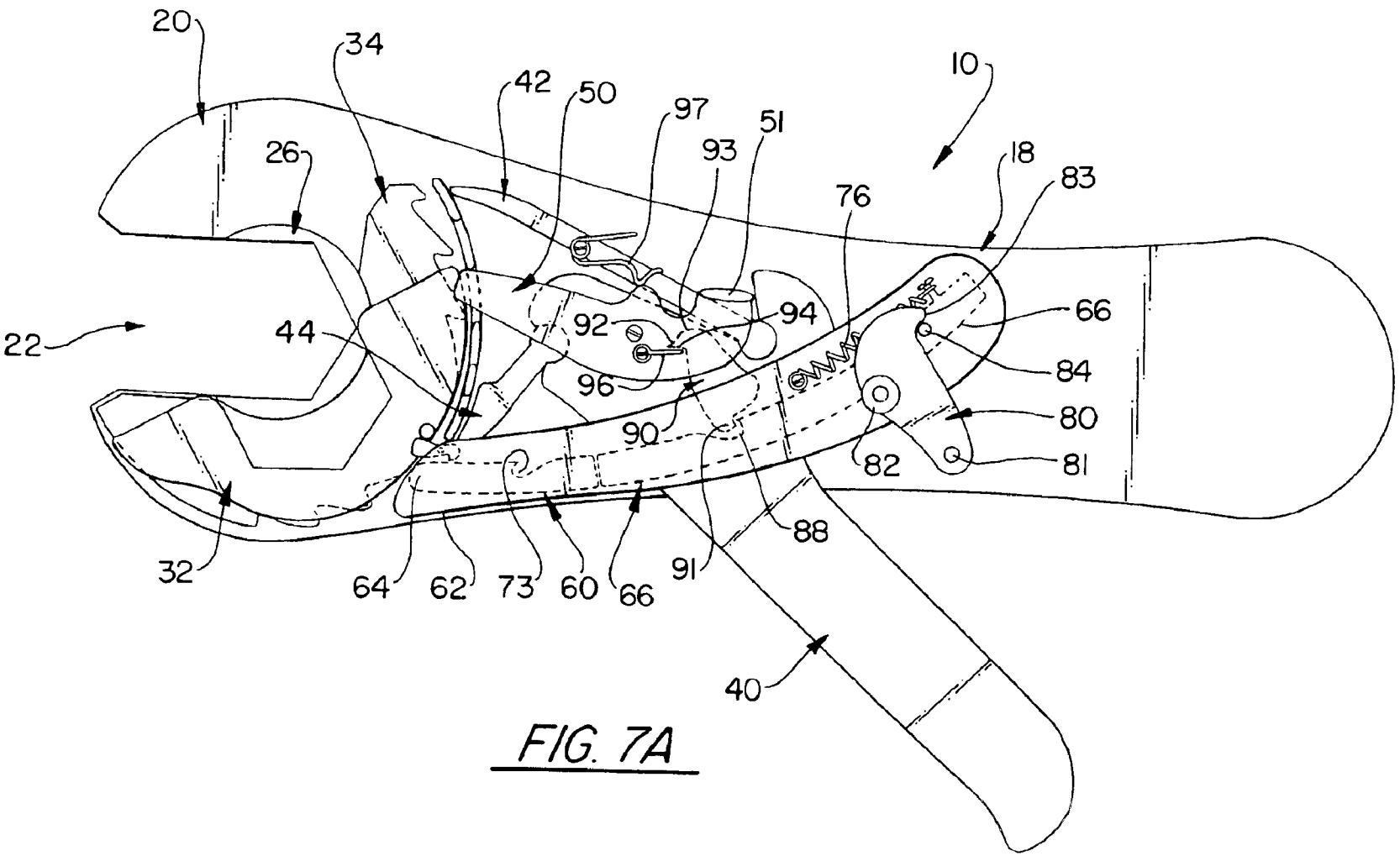

In operation, the rear push bar segment 66 is held in the loaded position, after having forced the forward push bar segment 64 outwardly into engagement with the moving jaw member 32, as seen at the starting position shown in FIG. 3*a*. At this position, the moving jaw member 32 is in alignment with the fixed jaw member 26 for operative engagement with the work piece. As the lever 40 is operated throughout the series of operational movements to rotate the moving jaw member 32 in the clockwise direction, as seen in FIGS. 3*a*–5*a*, the forward push bar segment 64 maintains pressure on the moving jaw member 32 to maintain the moving jaw member 32 in operative engagement with the work piece. Then, upon reaching the fully clockwise rotated position, as seen between FIGS. 5*a* and 6*a*, the trip pin 70 hits pawl 74 to cause the pawl 74 to pivot and release from the notch 73, thereby allowing spring 70 to pull the forward push bar segment to the retracted position within the housing 64. This releases pressure on the moving jaw member 32, allowing spring 39 to pull the jaw member 32 to the retracted position, away from the work piece and central axis of rotation, as seen in FIG. 7*a*. In this position, the forward push bar segment 64 is retracted within the housing and in engagement with the rear push bar segment 66, while the rear push bar segment 66 is held in the loaded position.

Figure 8:
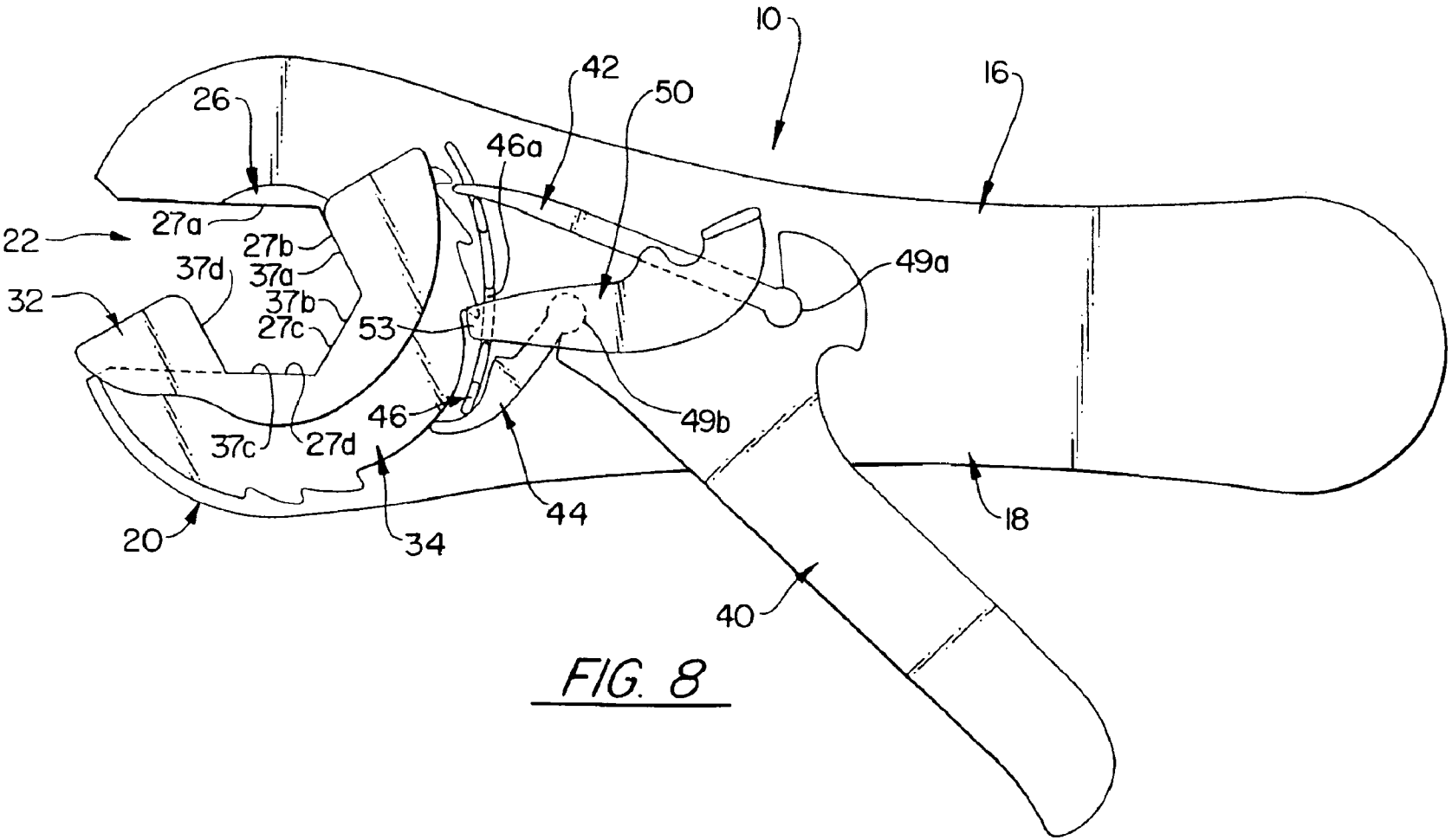
Figure 8A:
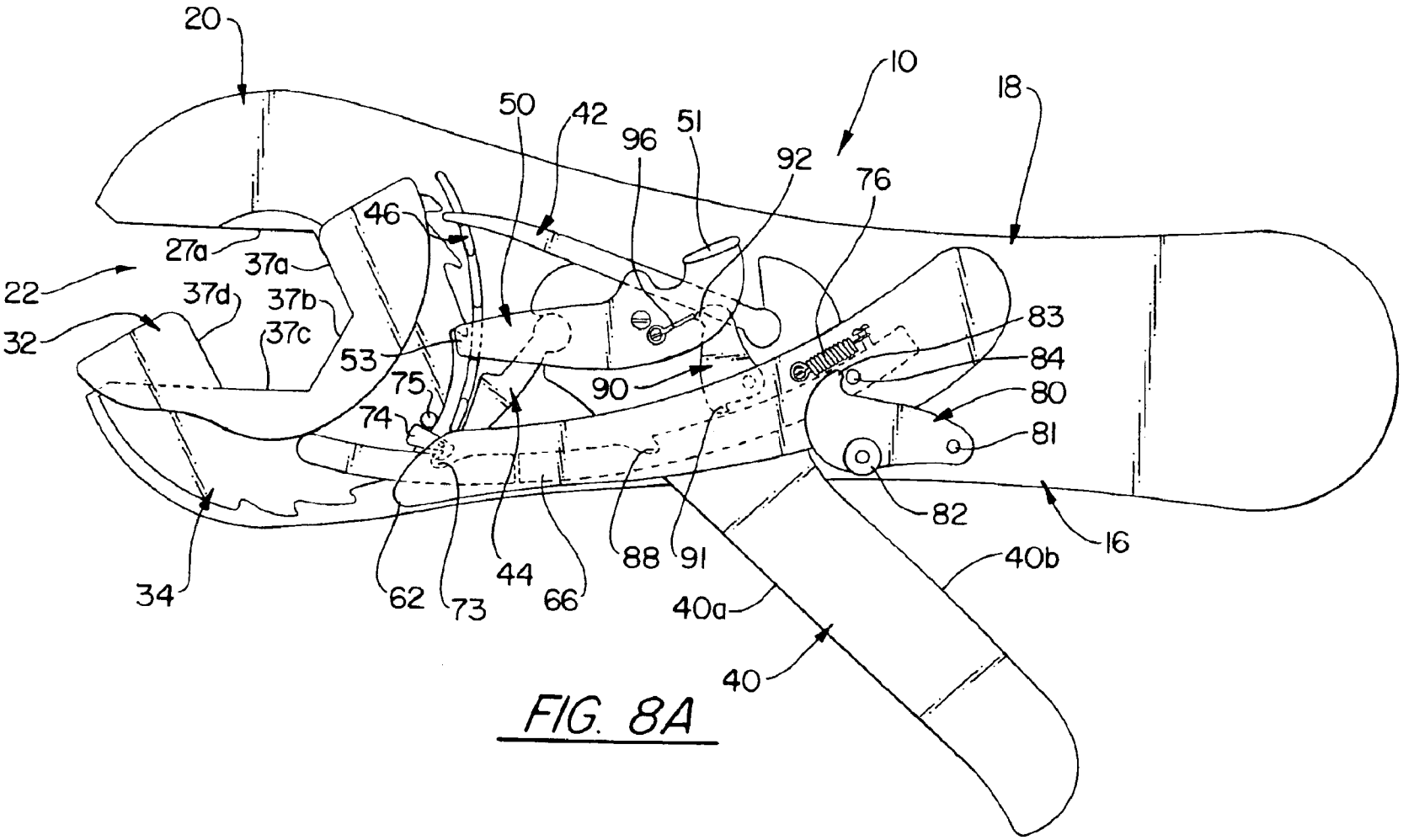
Figure 9:
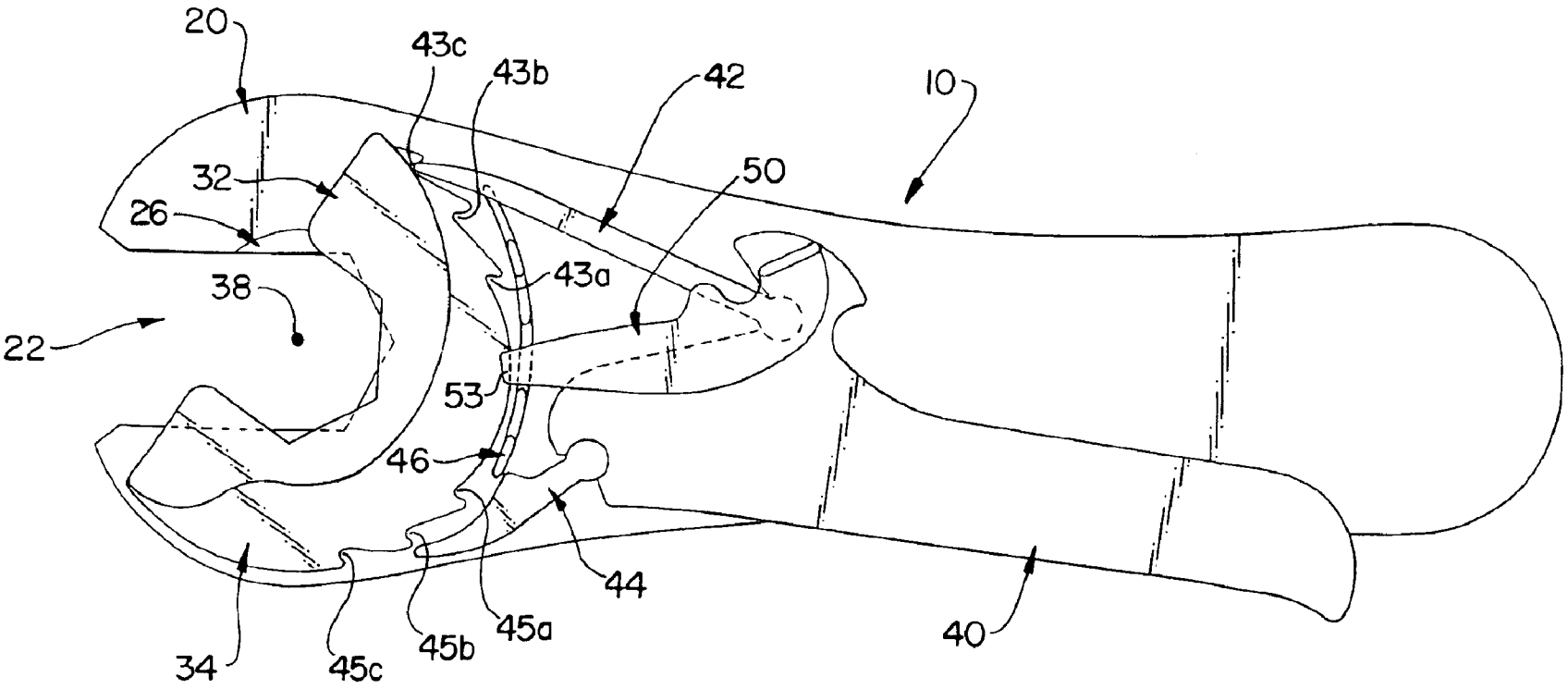
Figure 9A:
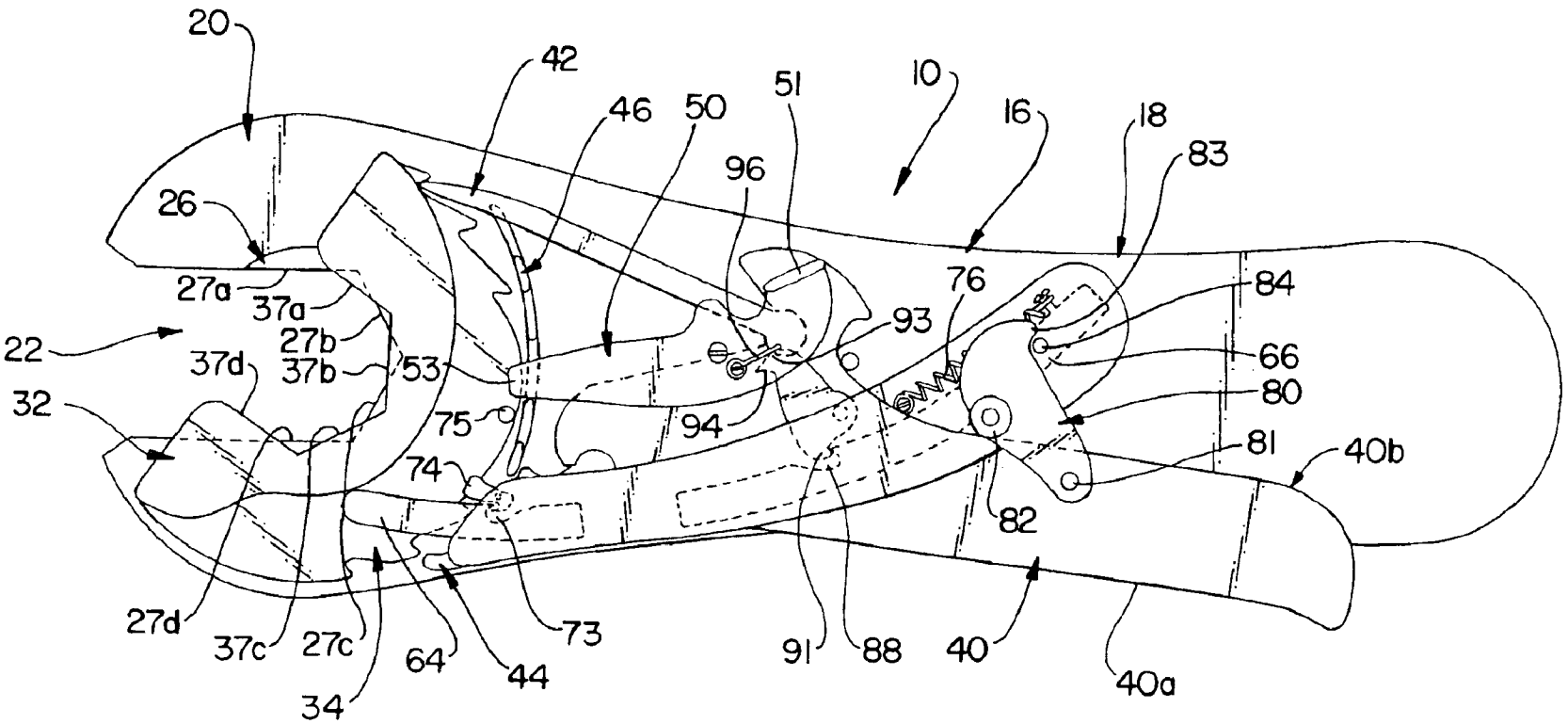

When pivoting switch 50 is operated to reverse direction of rotation of the jaw member 32 in the counterclockwise direction, by sliding the arcuate shield 46 to the left, the movement of the pivoting switch 50 causes a wire element 96 fixed to the pivoting switch 50 to be forced against a shoulder or flat face 94 on the pawl 90, causing the pawl 90 to pivot so that the hooked portion 91 is released from the notch 88 in the rear push bar segment 66. This results in spring 76 pulling the rear push bar segment 66 forward, within the housing 62, and into forced engagement with the forward push bar segment 64, thereby urging the forward push bar segment 64 to the extended position, as seen in FIG. 8*a*. At this position, the pawl 74 again engages within notch 73 to hold the forward push bar segment 64 in the extended position, in forced engagement with the jaw member 32 so that the jaw member 32 is maintained in the operative position and in engagement with the work piece. Upon squeezing the lever 40 during the next operative movement, as seen in FIG. 9*a,* a roller 82 on hook member 80 engages the inner side surface 40*b* of the squeeze lever, moving the hook member 80 about pivot 81 so that a hooked end 83 of the hook member 80 catches pin 84 on the rear push bar segment 66. As the lever 40 is squeezed to the fully compressed position, into the housing, as seen in FIG. 9*a,* the hook member 80 applies a force on pin 84 to pull the rear push bar segment 66 back within the housing 62 until the hooked end 91 of pawl 90 engages within notch 88 to hold the rear push bar segment 66 in the loaded position. At this point, the wire element 96 is positioned on the opposite side of the pawl 90, as seen in FIG. 9*a.* Upon the next subsequent operation of pivoting switch 50, to switch direction of rotation of the jaw member 32, by moving arcuate shield 46 to the right, the wire element 96 is moved over a sloped surface 93 on the end of the pawl 90 until the wire element 96 drops into position in engagement with the shoulder 94 of the pawl 90. This positions wire element 96 for applying a pivoting force on pawl 90 upon the next subsequent operation of pivoting switch 50 to again switch direction of rotation of the jaw member 32, and thereby releasing the rear push bar segment 66 from the loaded position to again force the forward push bar segment 64 outwardly to the extended position, as described above.

While the instant invention has been shown and described in accordance with a preferred and practical embodiment thereof, it is recognized that departures from the instant disclosure are contemplated within the spirit and scope of the present invention which should not be limited except as defined in the following claims under the doctrine of equivalents.

What is claimed is:

1. A wrench comprising:

a handle;

a head with a mouth including a mouth opening and a base surrounding a central axis of rotation;

a fixed jaw member at said base of said mouth and including a plurality of angled surfaces positioned and disposed to partially surround said central axis of rotation;

a moving jaw assembly comprising a carriage and a moving jaw member slidably coupled to said carriage, said carriage including a plurality of spaced notches and said moving jaw member including a plurality of angled surfaces;

finger elements for ratcheting engagement within said plurality of notches on said carriage for drivingly rotating said moving jaw assembly selectively in either a clockwise direction or a counterclockwise direction about said central axis of rotation;

a lever extending from said handle and pivotally operable by squeezing and releasing to sequentially engage said finger elements with successive ones of said plurality of notches on said carriage to drivingly rotate said moving jaw assembly;

means for selectively controlling the direction of rotation of said moving jaw assembly about said central axis of rotation; and engagement means for moving said moving jaw member relative to said carriage between an operative position wherein said angled surfaces of said moving jaw member are positioned and disposed at the base of said mouth and partially surrounding said central axis of rotation, and a retracted position wherein said moving jaw member is moved away from said central axis of rotation to avoid obstructing said mouth opening.

2. The wrench as recited in claim 1 wherein said finger elements comprise a right finger moveably coupled to said lever and a left finger moveably coupled to said lever, each of said left and right fingers being structured and disposed for ratcheting engagement within a corresponding set of said plurality of notches in a sequential order to drivingly rotate said moving jaw assembly through a range of rotational movement about said central axis of rotation.

3. The wrench as recited in claim 2 wherein said means for selectively controlling the direction of rotation of said moving jaw assembly comprises;

a pivoting switch; and a shield in operative engagement with said pivoting switch and moveable between a first position to block engagement of said right finger with said corresponding set of notches on said carriage and a second position to block engagement of said left finger with said corresponding set of said notches on said carriage, said shield being moveable between said first and second position by pivoting movement of said pivoting switch.

4. The wrench as recited in claim 1 wherein said engagement means comprises:

actuating means operable between an extended position in forced engagement with said carriage to urge and maintain said moving jaw member in said operative position, and said actuating means being further operable to a released position to allow said moving jaw member to move to said retracted position; and biasing means for urging said moving jaw member to said retracted position upon operation of said actuating means to said released position.

5. A wrench comprising:

a handle;

a head with a mouth including a mouth opening and a base surrounding a central axis of rotation;

a fixed jaw member at said base of said mouth and including a plurality of angled surfaces positioned and disposed to partially surround said central axis of rotation;

a moving jaw assembly comprising a carriage and a moving jaw member moveably coupled to said carriage;

driving and ratcheting means for drivingly rotating said moving jaw assembly selectively in either a clockwise direction or a counterclockwise direction about said central axis of rotation;

a lever extending from said handle and pivotally operable by squeezing said lever to move said lever toward said handle and subsequently releasing said lever to allow said lever to move pivotally away from said handle, said lever operatively engaged with said driving and ratcheting means for operating said driving and ratcheting means to drivingly rotate said moving jaw assembly upon squeezing and releasing said lever;

means for selectively controlling the direction of rotation of said moving jaw assembly about said central axis of rotation; and engagement means for moving said moving jaw member relative to said carriage towards and away from said central axis of rotation.

* * * * *